United States Patent [19]

Hirschmeier et al.

[11] Patent Number: 4,619,707

[45] Date of Patent: Oct. 28, 1986

[54] METHOD FOR CHEMICALLY REMOVING ALUMINUM DIFFUSION LAYERS

[75] Inventors: Manfred Hirschmeier, Karlsfeld; Josef Kreitl, Viehbach, both of Fed. Rep. of Germany

[73] Assignee: MTU Motoren-und Turbinen-Union Muenchen GmbH, Munich, Fed. Rep. of Germany

[21] Appl. No.: 691,481

[22] Filed: Jan. 14, 1985

[30] Foreign Application Priority Data

Apr. 16, 1984 [DE] Fed. Rep. of Germany ..... 3414383

[51] Int. Cl.[4] ..... C23G 1/02

[52] U.S. Cl. ..... 134/3; 134/41; 156/665; 252/79.1; 252/79.5

[58] Field of Search ..... 134/2, 3, 41; 156/664, 156/665; 252/79.1, 79.5

[56] References Cited

U.S. PATENT DOCUMENTS

| | | | |
|---|---|---|---|
| 2,649,361 | 8/1953 | Springer et al. | 156/664 |
| 3,300,349 | 1/1967 | Tershin et al. | 156/665 X |
| 3,356,550 | 12/1967 | Stiffler et al. . | |

*Primary Examiner*—Benoit Castel

*Attorney, Agent, or Firm*—W. G. Fasse; D. H. Kane, Jr.

[57] ABSTRACT

Aluminum diffusion layers are removed from work piece surfaces, especially compressor and turbine blades, by exposing the respective surface areas to an aqueous solution of nitrobenzenesulfonic acid preferably in combination with other components, such as sodium compounds. Depending on the thickness of the layer to be removed the exposure time is within the range of about 30 to 90 minutes at a temperature below about 50° C.

8 Claims, No Drawings

METHOD FOR CHEMICALLY REMOVING ALUMINUM DIFFUSION LAYERS

FIELD OF THE INVENTION

The invention relates to a method for chemically removing aluminum diffusion layers from a work piece, especially such work pieces which have already been molded or cast or otherwise shaped, such as blades in flow type machines such as turbines or compressors. The invention also relates to using a special aqueous solution for the present purposes.

DESCRIPTION OF THE PRIOR ART

Prior methods for chemically removing of aluminum diffusion layers from work pieces are frequently cost and effort expensive while simultaneously requiring a relatively high temperature for the removal bath, for example 75° C. and higher temperatures. Prior art methods further require a long treatment duration frequently to be applied in several stages between which intermediate work steps, such as blasting, especially wet blasting are necessary. The last step of prior art methods frequently calls for the removal of a masking lacquer layer. The chemical means for the removal in prior art methods usually involve the use of nitric acid in a concentration of about 370 to 470 grams per liter and of phosphoric acid in a concentration of 620 to 720 grams per liter.

Due to the needed repeated treatment of the surfaces, according to the prior art it is practically impossible to avoid the danger that the basic material of which a work piece is made, is attacked and damaged by the removal chemicals, especially where already preshaped work pieces require such removal treatment. Additionally, the mentioned prior art method is rather uneconomical due to the substantial expenditures in work hours and materials.

OBJECTS OF THE INVENTION

In view of the above it is the aim of the invention to achieve the following objects singly or in combination:

to provide a method for the chemical removal of aluminum diffusion layers from work piece surfaces which may be performed in a simple and economical manner;

to avoid the danger of damaging the basic material of which the work piece is made by avoiding attacking the basic material or at least substantially reducing such attack; and to provide such a chemical removal method which is especially suitable for use in connection with work pieces which have already their final shape or configuration such as blades in turbines and compressors.

SUMMARY OF THE INVENTION

The above objectives have been achieved according to the invention by providing an aqueous solution of nitrobenzenesulfonic acid, preferably in a bath, and immersing the components or work pieces to be treated into such a bath for a suitable duration and at a suitable temperature. The duration will depend on the thickness of the layer to be removed. Practical durations in the range of about 30 to about 90 minutes have been found to be suitable, The temperature of the bath is advantageously about 20° C. to about 80° C., preferably about 40°-60° C. or less but not less than room temperature. Preferably, the nitrobenzenesulfonic acid aqueous solution also contains sodium compounds such as sodium cyanide and/or sodium hydroxide.

The important advantage of the invention is seen in that a single treatment completely removes an aluminum diffusion layer normally present on a work piece. The actual treatment duration in a test was somewhat less than an hour and the treatment took place at a bath temperature of 45° C.

DESCRIPTION OF A PREFERRED EXAMPLE EMBODIMENT AND OF THE BEST MODE OF THE INVENTION:

An aqueous solution was prepared in a bath holding one thousand liters or one thousand kilograms. The aqueous solution was prepared by introducing into the bath 50 kg of nitrobenzenesulfonic acid ($C_6H_4NO_2$-$SO_3H$) and about 100 to 150 kg sodium cyanide (NaCN) and about 10 to 15 kg of sodium hydroxide (NaOH) and then filling with water to make up a total batch of 1000 liters. In other words, the quantity of sodium hydroxide was about 10 percent by weight of the quantity of sodium cyanide.

After the bath has been prepared it was heated to a temperature below 50° C. and the work piece or work pieces were immersed into the bath for a duration of about an hour, depending on the thickness of the aluminum diffusion layer which normally is in the micrometer to millimeter range. In the test the layer was completely removed in less than an hour. If desired, maskings may be used. For example, covering the blade foot with a wax layer or a rubber layer has been found to be satisfactory with the added advantage that both the wax and/or the rubber are easily removed by a conventional melting out operation.

The preshaped work pieces such as compressor blades or turbine blades of a gas turbine propulsion plant for aircraft or the like are made of a base material such as a super alloy, a steel alloy, an iron nickel alloy, a titanium alloy or the like. Such components are covered with an aluminum diffusion layer having a thickness, as mentioned, in the range of about 1 micrometer to about o,5 millimeter . A typical range is 2 to 200 micrometers.

Modifications of the invention may be made within the scope of the claims without departing from the invention. For example, it is is considered to be within the scope of the invention to combine and subcombine the claimed and described features with each other as well as with features known as such. The invention is not limited to the described use in connection with compressor and turbine blades. The present method is also suitable for removing other aluminum containing sprayed layers not necessarily formed by diffusion. A suitable set of percentage ranges for the solution batch in percent by weight of the solution batch is as follows:

sodium cyanide: 10 to 20%,
sodium hydroxide: 1 to 2%, and
nitrobenzenesulfonic acid: 4 to 8%, the
remainder being water.

Although the invention has been described with reference to specific example embodiments, it will be appreciated, that it is intended, to cover all modifications and equivalents within the scope of the appended claims.

What is claimed is:

1. A method for chemically removing a continuous aluminum diffusion layer having a given thickness from a work piece surface without attacking the work piece material, comprising the following steps:

(a) preparing a batch of an aqueous solution containing:
nitrobenzenesulfonic acid,
sodium cyanide,
sodium hydroxide, and the remainder being water; whereby said sodium cyanide constitutes a main ingredient proportion of the batch, wherein said sodium hydroxide corresponds to about one tenth by weight of the main ingredient, and wherein said nitrobenzenesulfonic acid corresponds to less than about fifty percent by weight of said main ingredient, (b) and exposing said work piece surface to said aqueous solution for a length of time sufficient for the removal of said aluminum diffusion layer thickness and at a temperature below about 80° C.

2. The method of claim 1, wherein said length of time is within the range of 30 to 90 minutes.

3. The method of claim 2, wherein said temperature is within the range of about 20° C. to about 80° C.

4. The method of claim 1, wherein a batch of said aqueous solution comprises said sodium cyanide within the range of 10 to 20 percent by weight of the solution batch, said sodium hydroxide within the range of 1 to 2 percent by weight of the solution batch, said nitrobenzene sulfonic acid within the range of 4 to 8 percent by weight of the solution batch and wherein the remainder is water.

5. The method of claim 1, wherein said work piece is a component of a gas turbine system, and wherein said exposing involves immersing said component into a bath of said solution.

6. The method of claim 5, further comprising the step of applying a masking to surface areas of said component prior to said immersing step.

7. The method of claim 6, wherein said masking is applied as a wax coating or layer.

8. The method of claim 6, wherein said masking is applied as a rubber coating or layer.

* * * * *